US009243641B2

(12) United States Patent
Thut

(10) Patent No.: US 9,243,641 B2
(45) Date of Patent: Jan. 26, 2016

(54) PUMP FOR PUMPING MOLTEN METAL INCLUDING COMPONENTS THAT RESIST DETERIORATION

(71) Applicant: Bruno H. Thut, Chagrin Falls, OH (US)

(72) Inventor: Bruno H. Thut, Chagrin Falls, OH (US)

( * ) Notice: Subject to any disclaimer, the term of this patent is extended or adjusted under 35 U.S.C. 154(b) by 438 days.

(21) Appl. No.: 13/766,935

(22) Filed: Feb. 14, 2013

(65) Prior Publication Data

US 2013/0216386 A1 Aug. 22, 2013

Related U.S. Application Data

(60) Provisional application No. 61/599,602, filed on Feb. 16, 2012.

(51) Int. Cl.

| | |
|---|---|
| ***F04D 7/00*** | (2006.01) |
| ***F04D 29/58*** | (2006.01) |
| ***F04D 7/06*** | (2006.01) |
| *F04D 23/00* | (2006.01) |
| *F04D 13/08* | (2006.01) |

(52) U.S. Cl.
CPC *F04D 7/00* (2013.01); *F04D 7/065* (2013.01); *F04D 29/584* (2013.01); *F04D 13/08* (2013.01); *F04D 23/003* (2013.01)

(58) Field of Classification Search
CPC ..... F04D 7/00; F04D 7/06; F04D 7/065; F04D 13/08; F04D 23/003; F04D 29/584; F04D 29/5853
See application file for complete search history.

(56) References Cited

U.S. PATENT DOCUMENTS

| | | | | |
|---|---|---|---|---|
| 4,621,017 | A * | 11/1986 | Chandler | C04B 41/52 427/113 |
| 5,143,357 | A * | 9/1992 | Gilbert | C21C 7/00 266/235 |
| 5,951,243 | A * | 9/1999 | Cooper | F04D 7/065 415/110 |
| 6,093,000 | A * | 7/2000 | Cooper | F01C 21/106 417/423.15 |
| 6,355,206 | B1 * | 3/2002 | Hanzawa | C04B 35/573 266/239 |
| 7,507,365 | B2 | 3/2009 | Thut | |
| 7,687,017 | B2 | 3/2010 | Thut | |
| 2012/0328428 | A1 | 12/2012 | Thut | |

OTHER PUBLICATIONS

Ray Peterson, Review of Aluminum Dross Processing, Light Metals, Ed. by W. Schneider, The Minerals, Metals & Materials Society, 2002.

* cited by examiner

*Primary Examiner* — Igor Kershteyn
(74) *Attorney, Agent, or Firm* — Pearne & Gordon LLP

(57) ABSTRACT

A pump for pumping molten metal includes a pump shaft having an upper end and a lower end. A motor is connected to the upper end of the shaft. An impeller is fastened to the lower end of the shaft. Support structure supports the motor above the molten metal. A base is disposed below the support structure including an impeller chamber in which the impeller is rotated by activation of the motor. The base includes at least one inlet opening leading to the impeller chamber and at least one outlet passageway leading from the impeller chamber. At least one support post extends between the support structure and the base enabling the base to be submerged in the molten metal beneath the support structure. A device enables the post to resist deterioration while the post is disposed in the molten metal.

18 Claims, 10 Drawing Sheets

PUMP FOR PUMPING MOLTEN METAL INCLUDING COMPONENTS THAT RESIST DETERIORATION

TECHNICAL FIELD

This disclosure pertains to pumps for molten metal and, in particular, to avoiding deterioration of components of such pumps.

TECHNICAL BACKGROUND

Pumps for pumping molten metal include refractory components (e.g., made of graphite) to withstand the harsh molten metal environment (e.g., molten aluminum). Nevertheless, the pump components inevitably fail and need to be replaced periodically, leading to undesirable pump down time and labor and material costs repairing the pump. The components of the pump may fail for various reasons, but one problem is that the posts that submerge the base containing the rotating impeller in the molten metal, inevitably wear near a surface of the molten metal where dross is located. Replacing the posts of some pumps is a difficult procedure if the posts are cemented to the base. The inventor's company, High Temperature Systems, Inc., offers a cementless pump in which the posts are connected to the base with fasteners and no cement is needed, which makes post replacement easier. Nevertheless, it would be advantageous if the life of such pump components could be extended.

BRIEF DESCRIPTION OF EXAMPLE EMBODIMENTS

Turning now to example embodiments of the disclosure, a first aspect features a pump for pumping molten metal that includes a pump shaft having an upper end and a lower end. A motor is connected to the upper end of the shaft. An impeller (also referred to as a rotor) is fastened to the lower end of the shaft. Support structure supports the motor above the molten metal. A base is disposed below the support structure including an impeller chamber in which the impeller is rotated by activation of the motor. The base includes at least one inlet opening leading to the impeller chamber and at least one outlet passageway leading from the impeller chamber. At least one support post extends between the support structure and the base enabling the base to be submerged in the molten metal beneath the support structure. A device enables the post to resist deterioration from at least one of oxidation and abrasion while the post is disposed in the molten metal. For example, the device can resist deterioration of the post by maintaining the post at a temperature that inhibits an oxidation reaction of metal oxides in the molten metal and the post material and/or the device can resist deterioration of the post by moving dross away from the post so as to inhibit abrasion of the post caused by contact with the solid dross material. The movement of the solid dross against the posts and/or rotation of the shaft in solid dross can lead to deterioration of these components by abrasion.

Referring to specific features of the first aspect, the post can include a passageway along its length and the device that enables the post to resist deterioration includes a gas source and a conduit that extends between the gas source and the passageway. The device that enables the post to resist deterioration can include a manifold disposed around and fastened to the motor, wherein air travels around the motor for cooling the motor, enters the manifold and travels from an opening in the manifold to the post. An airflow directing member extending from the manifold can release air along or near an exterior surface of the shaft. The manifold opening can release air along or near an exterior surface of the post. The post can include a passageway and a conduit extends between the manifold opening and the passageway, wherein air in the manifold flows into the passageway and enables the post to resist oxidation. The gas source can include air and/or inert gas under pressure. The passageway can extend in the post to a location near an interface of molten metal and air; for example, the passageway can be located only above the interface.

Referring to further specific features that apply to the first aspect of the disclosure, at least one opening can extend from the post passageway to an exterior surface of the post, wherein gas in the passageway travels through the opening out the post and along or near the post (e.g., along its exterior surface). The opening can be located near the interface of molten metal and air. The passageway can extend to and end at an upper location of the post above the interface of molten metal and air, and the gas travels through the opening and downward along or near the post (e.g., along its exterior surface). The passageway can extend to and end at a lower location of the post below the interface of molten metal and air, and the gas travels through the opening out the post and upward along or near the post (e.g., along its exterior surface). The gas can have a density that is less than or greater than a density of air enabling the gas to travel upward or downward along or near the post, respectively. The post can be comprised of graphite. The post can include a ceramic sleeve.

A second aspect of the disclosure features a pump for pumping molten metal that includes a pump shaft having an upper end and a lower end. A motor is connected to the upper end of the shaft. An impeller is fastened to the lower end of the shaft. Support structure supports the motor above the molten metal. A base is disposed below the support structure including an impeller chamber in which the impeller is rotated by activation of the motor. The base includes at least one inlet opening leading to the impeller chamber and at least one outlet passageway leading from the impeller chamber. At least one support post extends between the support structure and the base enabling the base to be submerged in the molten metal beneath the support structure. A gas source and a gas flow member leading from the gas source to a location above the post enable gas to flow outside the post that moves dross solids away from the post.

Many additional features, advantages and a fuller understanding of the invention will be had from the accompanying drawings and the detailed description that follows. It should be understood that the above Brief Description provides a description in broad terms while the following Detailed Description provides a more narrow description and presents embodiments that should not be construed as necessary limitations of the broad invention as defined in the claims.

DETAILED DESCRIPTION

Figure 1:
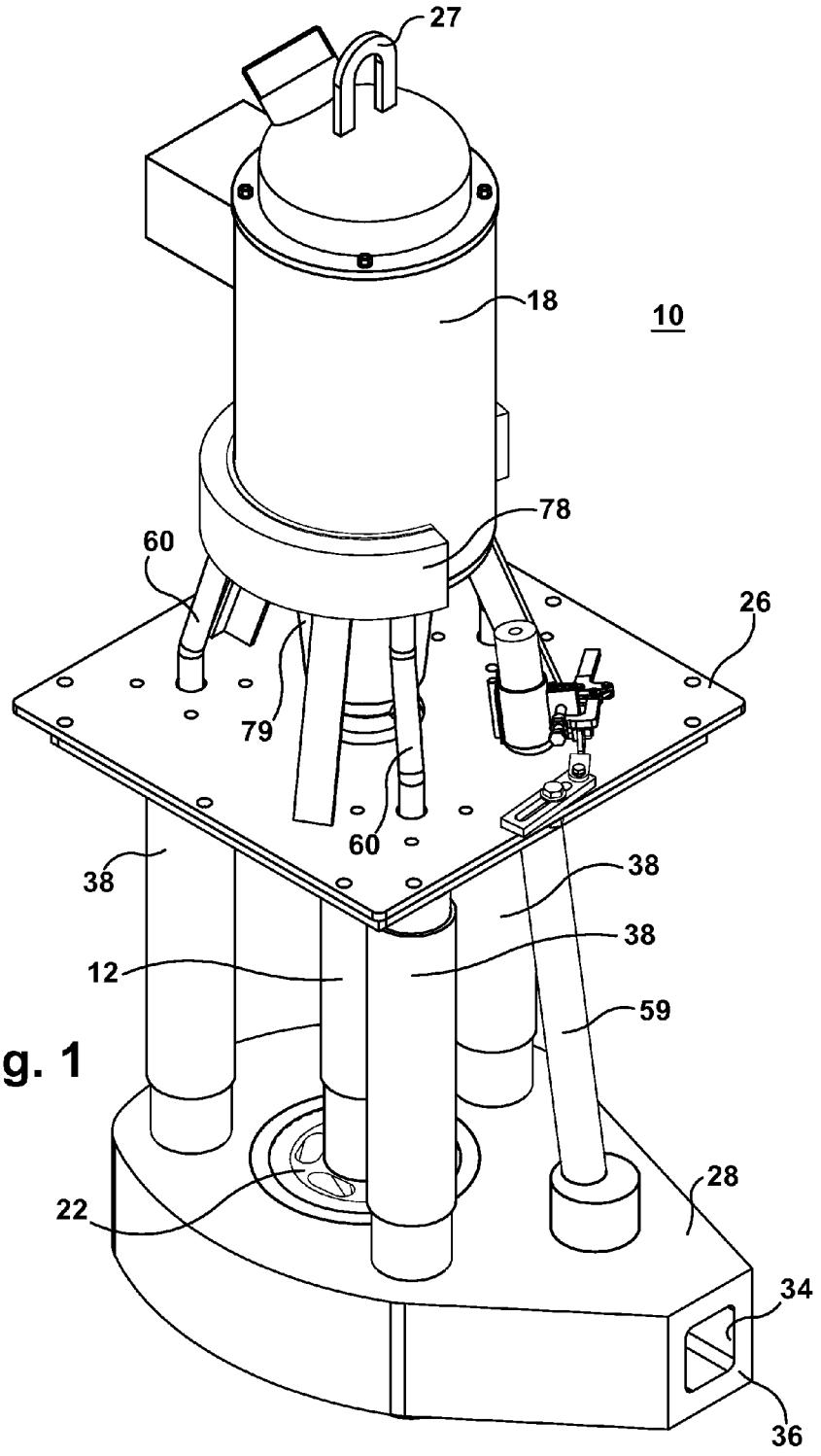
FIG. 1 is a perspective view of one example of a pump for pumping molten metal according to this disclosure.
Figure 2:
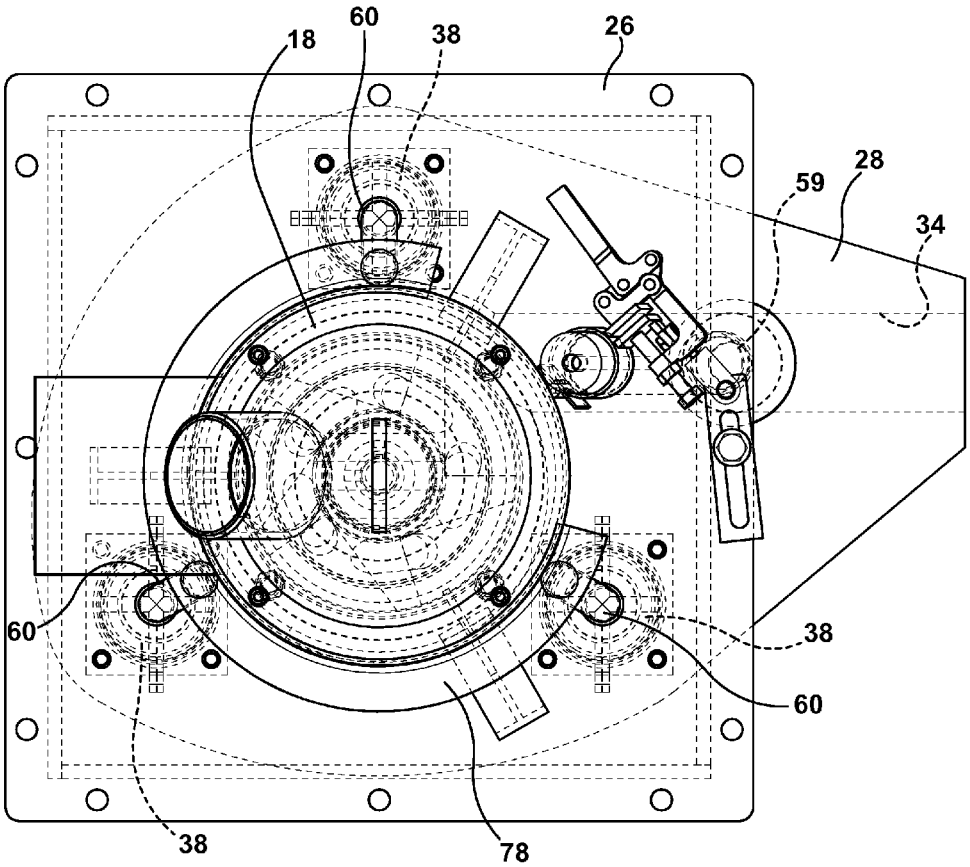
FIG. 2 is a top view of the pump of FIG. 1.
Figure 3:
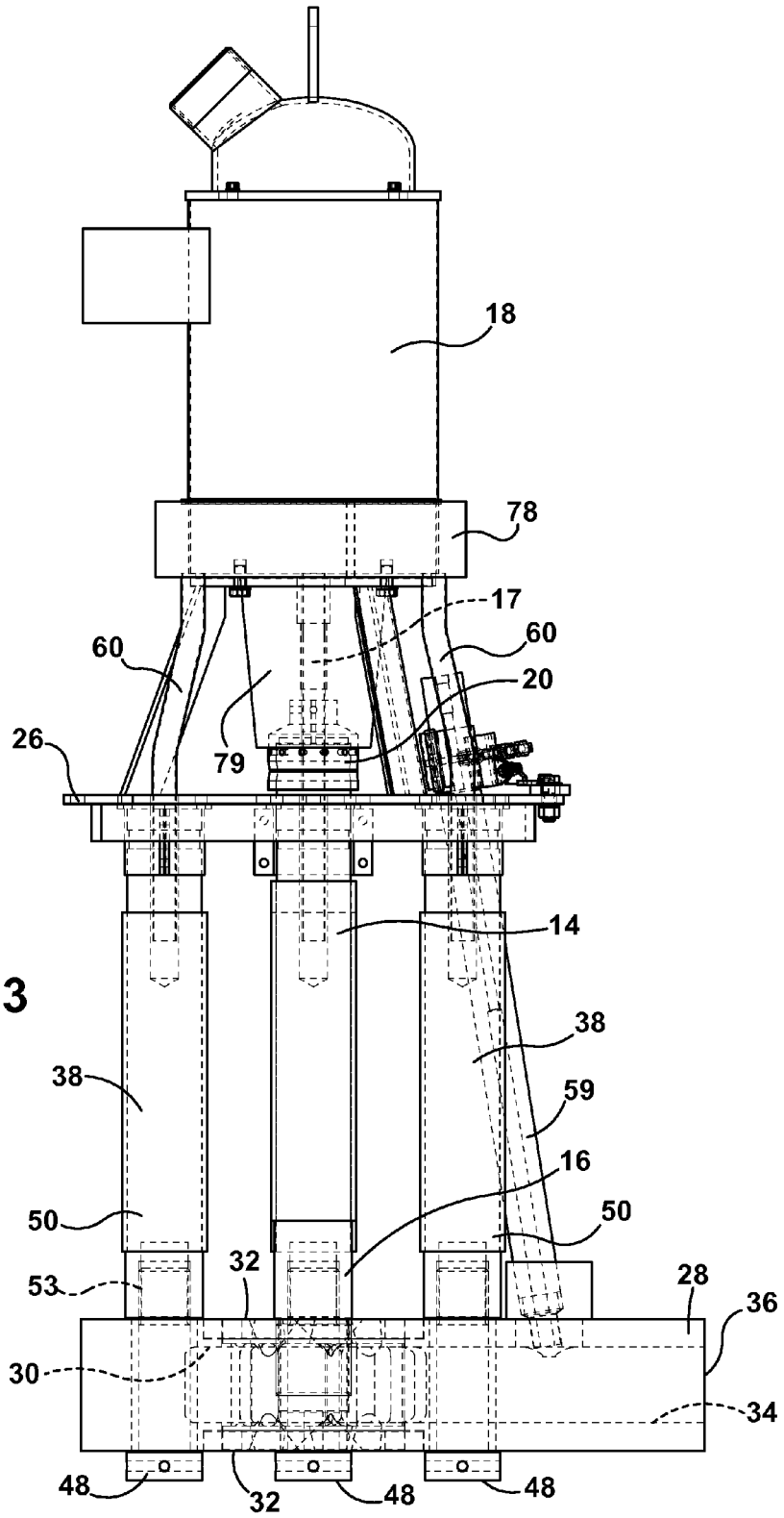
FIG. 3 is a left side view of the pump of FIG. 1.
Figure 4:
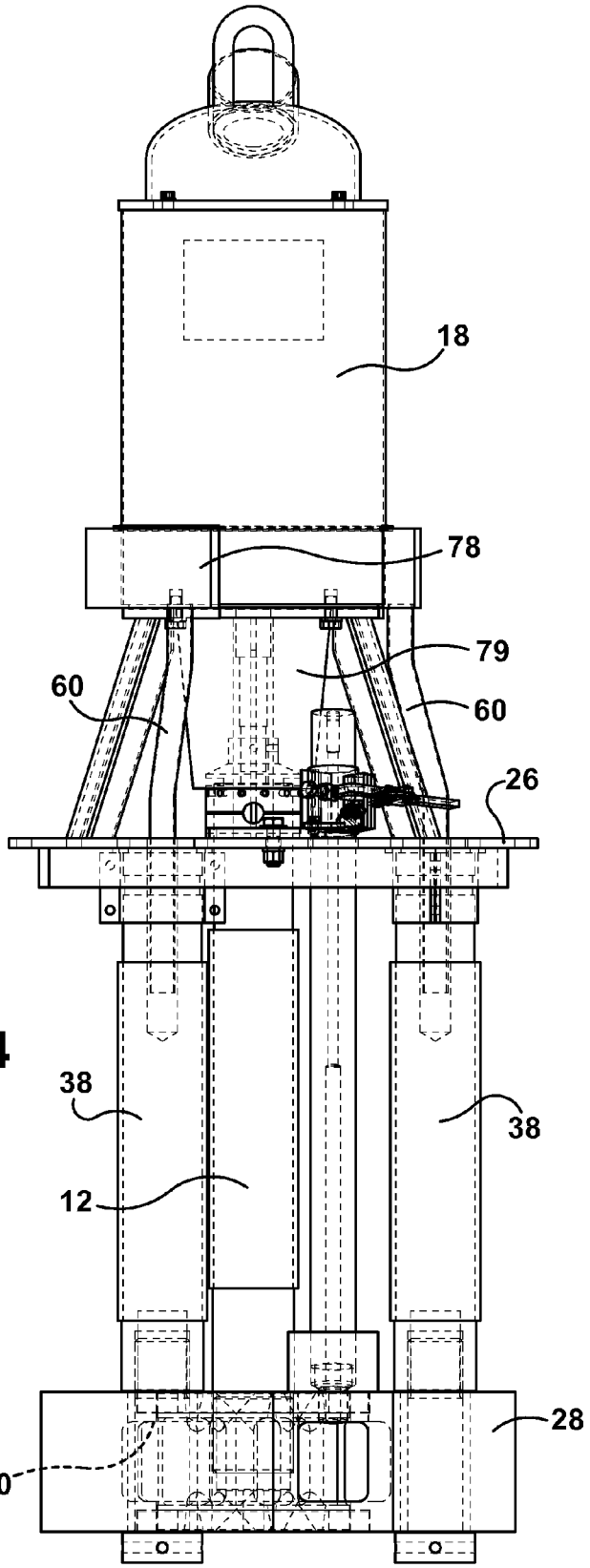
FIG. 4 is an end view of the pump of FIG. 1.
Figure 5:
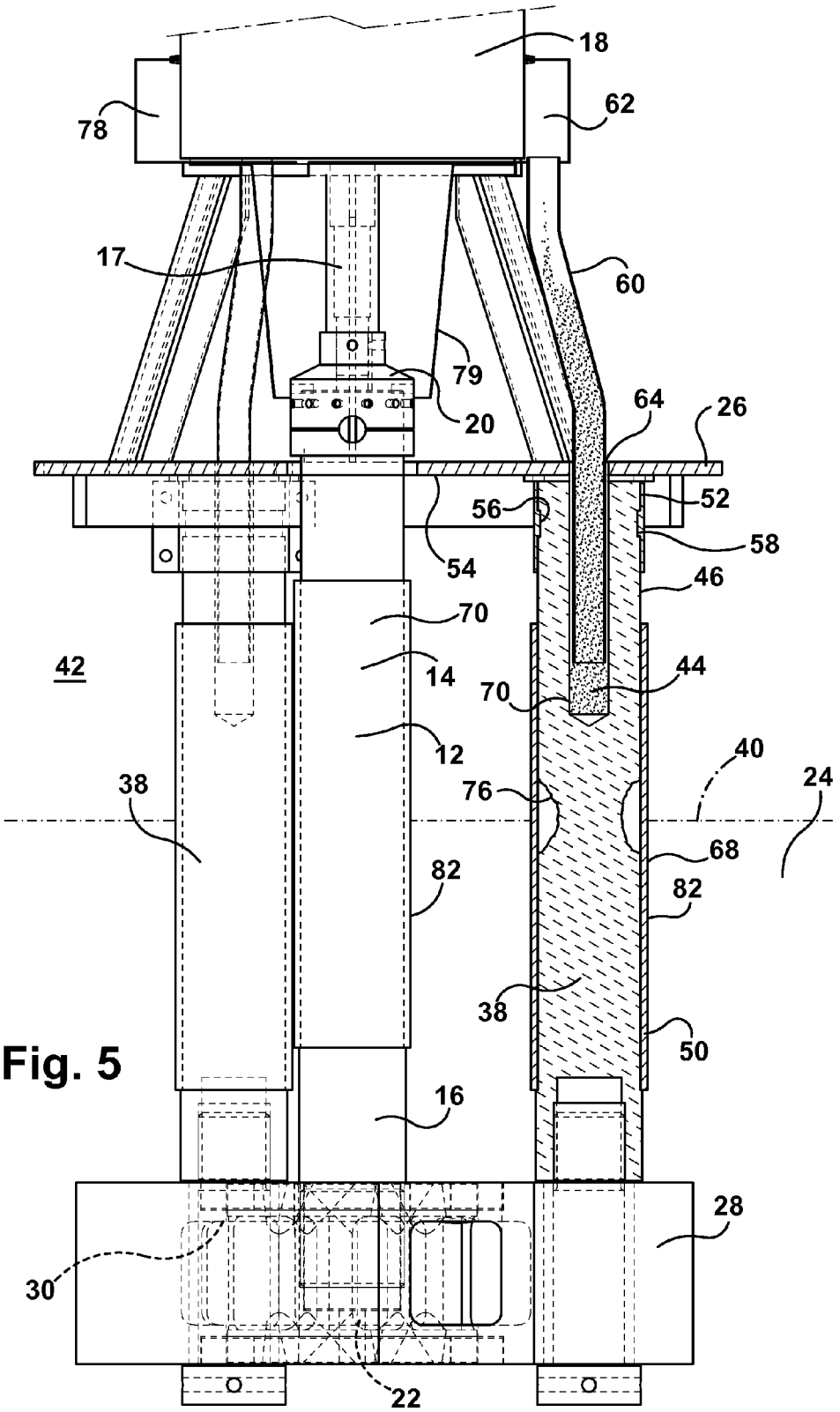
FIG. 5 is a vertical cross-sectional view of the pump of FIG. 4, showing gas (e.g., air) traveling from a manifold around the motor, through a conduit into a passageway of a post of the pump.

Referring to FIGS. 1-3, a pump 10 for pumping molten metal includes a pump shaft 12 having an upper end portion 14 and a lower end portion 16. The upper end portion 14 of the shaft 12 is connected to a drive shaft 17 of a motor 18 by a coupling 20 while an impeller (also referred to as a rotor) 22 is fastened to the lower end portion 16 of the shaft 12. The motor 18 is supported above molten metal 24 by support structure 26 (FIG. 5). The level at which the pump is submerged in the molten metal, which is shown in the drawings, is approximate and may be different in practice. A base 28 is disposed below the support structure 26 and includes an impeller chamber 30 in which the impeller 22 is rotated by activation of the motor 18. The base 28 can include at least one inlet opening 32 leading to the impeller chamber 30 (upper and lower inlet openings 32 being shown in FIG. 3 for example) and at least one outlet passageway 34 leading from the impeller chamber 30 to an exterior surface 36 of the base. Alternatively, or in addition to the outlet passageway leading to an exterior surface of the base, at least one outlet passageway leads from the impeller chamber to a hollow riser (not shown) for transfer of the molten metal to another location in a manner known in the art. An elbow and other components of such a transfer pump are not shown but are known in the art. It should be appreciated that the pump of this disclosure could be designed to be a multifunctional pump with multiple transfer and/or discharge functions within the scope of example embodiments of this disclosure, as disclosed in U.S. Pat. Nos. 7,687,017 and 7,507,365, which are incorporated herein by reference in their entireties.

At least one support post 38 extends between the support structure 26 and the base 28 for enabling the base to be submerged in the molten metal. The post is elongated and typically cylindrical, but can be any other shape such as square in cross-section. The shaft 12, optional riser, and post(s) 38 are at least partially submerged in the molten metal 24 beneath the support structure 26.

The support structure 26 can be a metal motor mount plate. The motor can be mounted to the motor mount plate. A hook 27 can be provided on the motor or elsewhere on the pump and fastened to a device that can suspend or lift the pump into and out of the molten metal bath. The posts can be secured to the bottom of the motor mount plate and to the base in any manner. A fastener 48 can be used at a lower end portion 50 of each post 38, between the base 28 and post 38, without a need for cement to fasten the post to the base in the design of a cementless pump sold by High Temperature Systems, Inc. as disclosed in U.S. patent application Ser. No. 13/169,083, entitled "Cementless Pump for Pumping Molten Metal," which is incorporated herein by reference in its entirety. For example, the fastener 48 may be an exteriorly threaded, refractory fastener that extends into the base and is threaded into a threaded opening 53 at the lower end portion of the post. Referring to attachment of an upper end portion 46 of the post 38, for example, a split socket 52 may be fastened to a lower surface 54 of the motor mount plate 26 including an arcuate protrusion 56 that extends into an arcuate recess 58 at the upper end 46 of the post 38 and retains the post in a fixed position therein.

A gas (and possibly flux) injection conduit 59 (FIGS. 1-3) may be mounted to the motor mount, extend through an opening in the motor mount into a connection leading into the base, such as into the discharge passageway 34.

In accordance with this disclosure, the support post(s) 38 is maintained at a reduced temperature that is believed will enable the post(s) to resist oxidation caused by the molten metal environment (e.g., being subjected to oxides of the dross); and/or abrasive wear on the post(s) 38 is avoided by moving the dross away from contact with the post(s). For example, oxidation of the support post may be caused by reaction of oxygen from aluminum oxides of the dross and the material of the post at or near the molten metal-air interface. The components of the pump 10 that contact the molten metal 24 (including the posts, shaft, optional shaft sleeve, riser, impeller and base) are formed of heat resistive or refractory material such as graphite, ceramic material, graphite with a ceramic sleeve (e.g., a silicon carbide sleeve), and/or graphite impregnated with refractory material (e.g., alumina or aluminum oxide compound). In view of its relatively low cost, thermal shock resistance and good mechanical properties in the molten metal, the posts 38 are typically composed of graphite. In particular, the graphite of the post 38 may optionally be impregnated with a ceramic material by to retard oxidation and hence to improve the life of the post.

When aluminum is pumped through a furnace or hearth, for example, oxygen is present at a location at or near the interface 40 between the molten metal 24 and the air 42 above the molten metal (e.g., oxygen present in aluminum oxide in dross) that may degrade the posts 38. Dross is a by-product of melting aluminum metal. Dross is a mixture of aluminum metal and aluminum oxides with minor amounts of other constituents and is treated in various ways such as by using flux, as disclosed for example, in the paper, Ray Peterson, Review of Aluminum Dross Processing, Light Metals, Ed. by W. Schneider, The Minerals, Metals & Materials Society (2002), which is incorporated herein by reference in its entirety. By maintaining the post 38 at a lower temperature than the temperature at which it would ordinarily be while in and/or above the molten metal 24, it is believed the oxidation reaction of the post will be slowed. When inert gas flows along or near the post and/or shaft (e.g., along an exterior surface of the post and/or shaft) this may contribute to slowing the oxidation reaction and/or avoiding detrimental abrasion, by moving the dross (e.g., aluminum oxide) solids away from the post and/or shaft. It is believed that reducing the temperature of the post and/or moving the dross solid material away from the post, will result in a longer life of the post 38 and a resultant greater interval between pump reconstruction work, which is conducted when posts and other pump components fail or are about to fail. This in turn is expected to provide a significant savings to operators of pumps for pumping molten metal in avoiding the cost of replacement pump components, costs associated with pump down time and labor costs of pump reconstruction.

Deterioration of the posts may be avoided by maintaining the posts 38 at a temperature that enables them to resist oxidation, and/or wear of the posts by abrasion from the dross can be avoided, in any manner, using any equipment, material or method, according to this disclosure. However, one example of a way to keep the posts 38 at a reduced temperature and/or to avoid abrasion from the dross, while they are submerged in the molten metal (see FIGS. 1-5) is to design the posts so as to include a passageway 44 at an upper end 46 thereof extending to and ending near the surface of the molten metal, e.g., the molten metal-air interface 40.

The motor 18 can be an air or electric motor, for example. If the electric motor is used, then cooling air can be applied around or inside the motor. Turning to FIGS. 1-7, a manifold 78 can be disposed around the bottom of the motor 18 (FIG. 1) and, for example, a generally conical gas flow member 79 can extend over or near the coupling 20 that connects the motor drive shaft 17 and the pump shaft 12. A portion of the cooling air that is directed into the opening at the top of the motor and flows inside the motor housing in a conventional manner can be directed into the manifold 78 and along or to the post and/or pump shaft.

Figure 6:
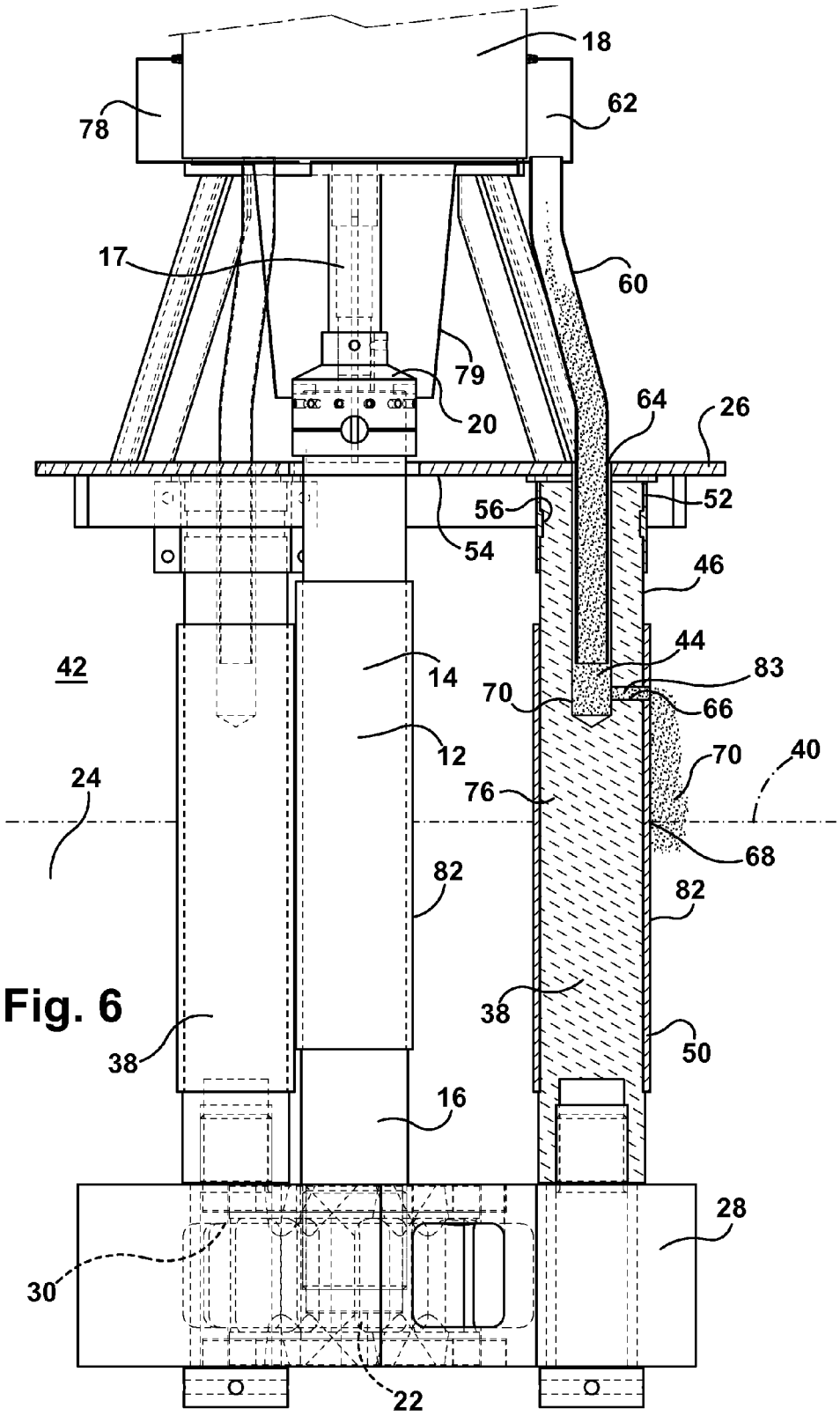
FIG. 6 is a vertical cross-sectional view of a variation of the pump of FIG. 4, showing gas traveling into a post of the pump and then out an upper opening in the post to an exterior surface of the post, from which the gas travels downward along or near the post.
Figure 7:
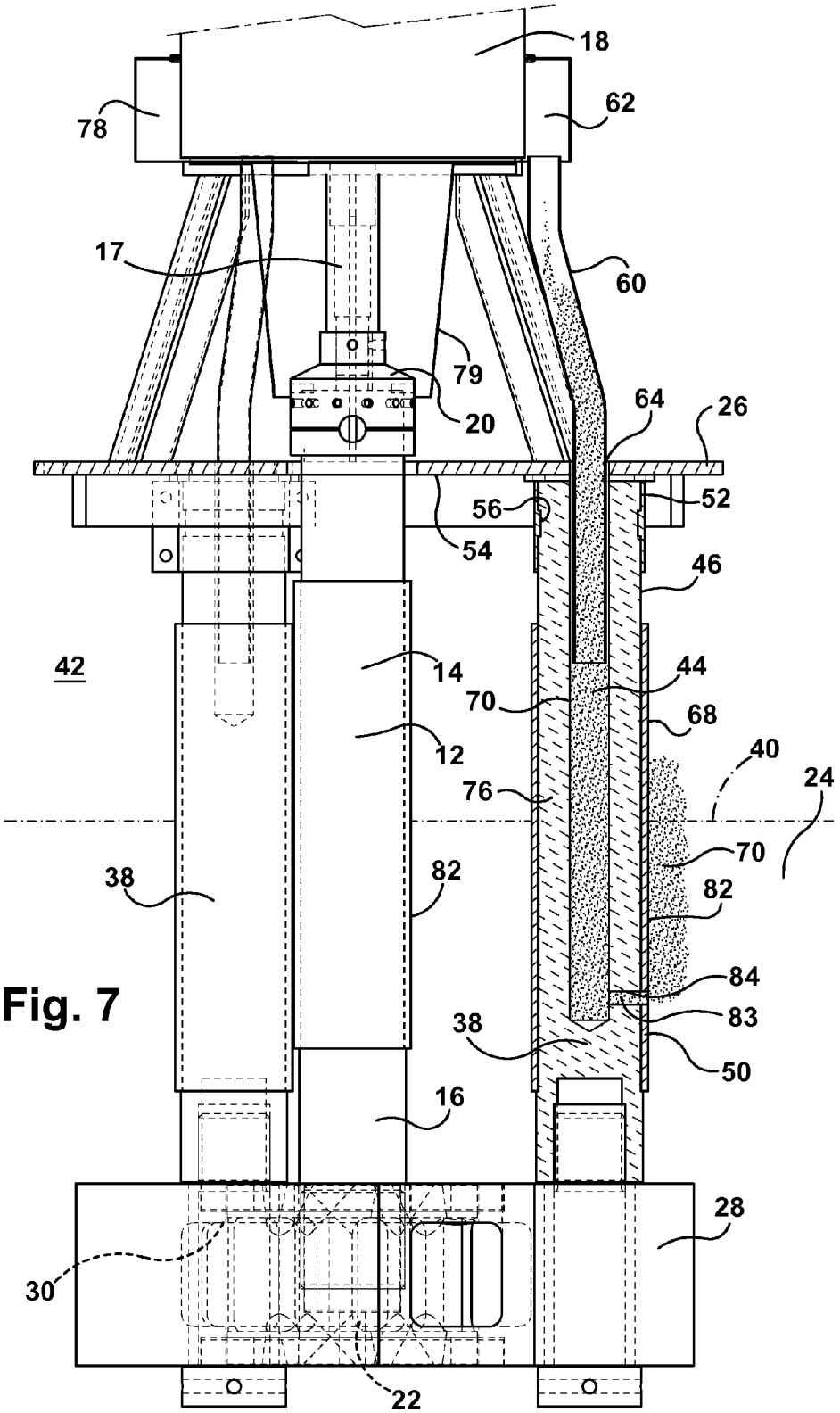
FIG. 7 is a vertical cross-sectional view of a variation of the pump of FIG. 4, showing gas traveling into a post of the pump and then out a lower opening in the post to an exterior surface of the post, from which the gas travels upward along or near the post.

A conduit 60 can be connected to the manifold 78 as the gas source so that the air 70 feeds into a passageway 44 formed in the post 38 (FIGS. 6 and 7). The conduit 60 extends through an opening 64 in the motor mount plate 26 and up to or into the passageway 44. The passageway 44 can be a blind hole inside the upper end 46 of the post 38. An appropriate and effective flow rate of the gas can be determined empirically according to the process conditions. The conduit 60 can be bifurcated to include an inlet passageway section and an outlet passageway section to allow the gas to feed into and out of the passageway 44. A conduit 60 can extend from the manifold 78 through opening 64 in the motor mount plate and into the passageway 44 of each of the posts.

Air 70 may optionally be directed from the manifold 78, through the conical member 79 and down the pump shaft 12, which also may inhibit oxidation and/or dross abrasion of the shaft. However, it is not desirable to flow gas into the impeller chamber 30 as this can cause deleterious cavitation in the impeller chamber. Flow of gas 70 along the pump shaft 12 is shown only in FIG. 5, but could occur in any aspect of this disclosure.

Figure 8:
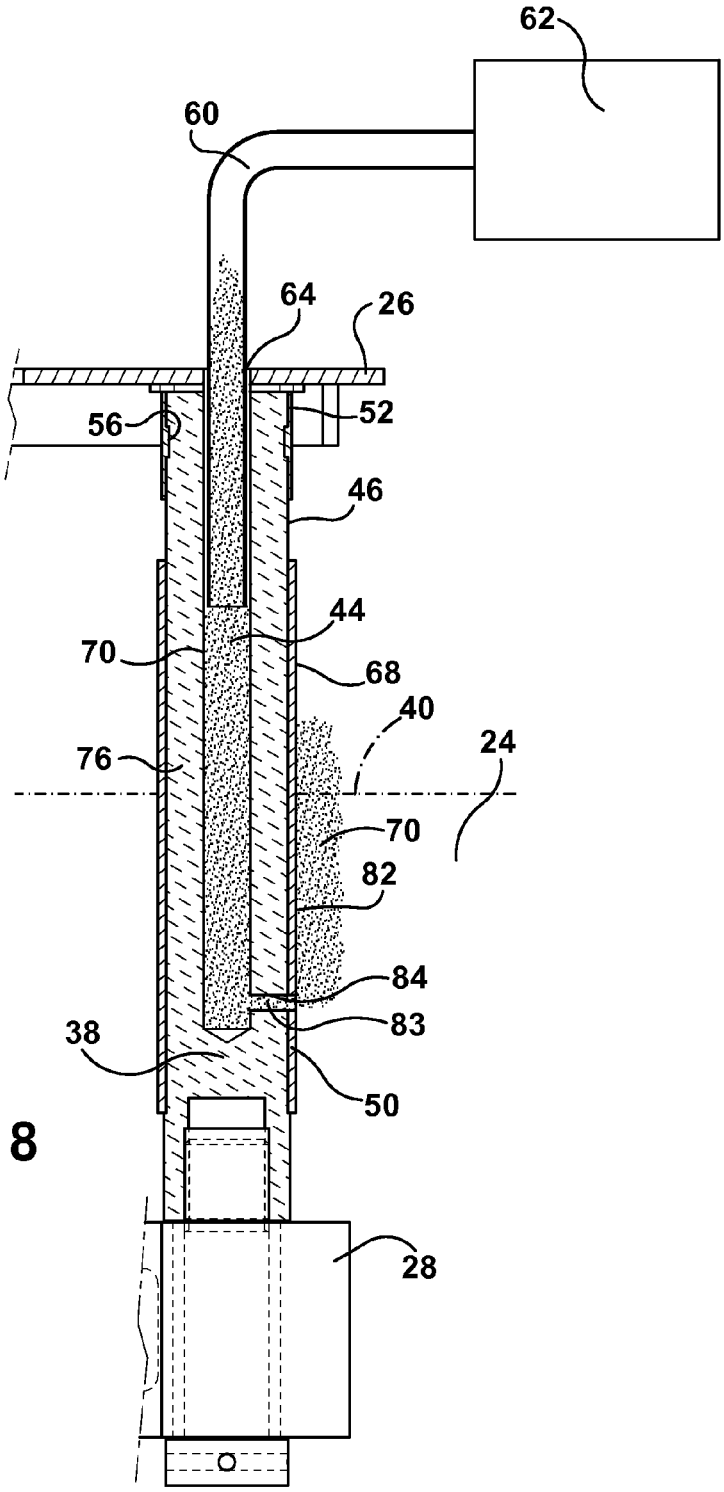
FIG. 8 is a vertical, partial cross-sectional view showing use of a separate gas source (e.g., a tank of gas under pressure) instead of or in addition to the gas from the manifold discussed above, applicable to any aspect of the disclosure.
Figure 9:
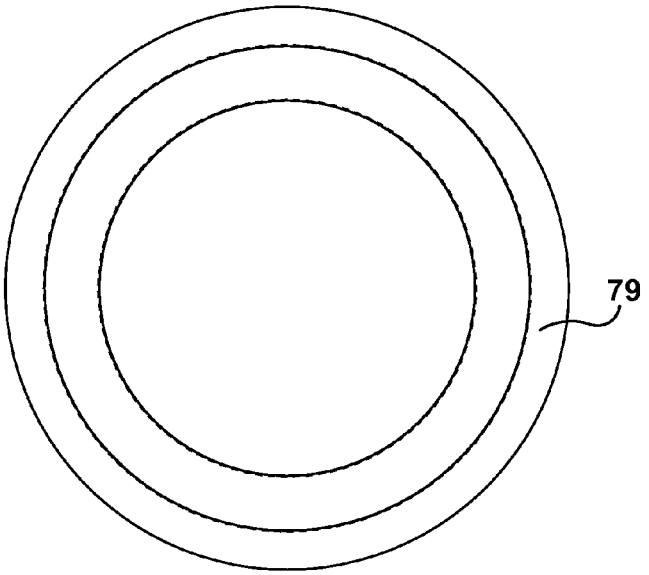
FIGS. 9 and 10 show an optional gas flow member that may extend from the manifold of FIG. 5 to flow gas along the pump shaft and possibly along the post.
Figure 10:
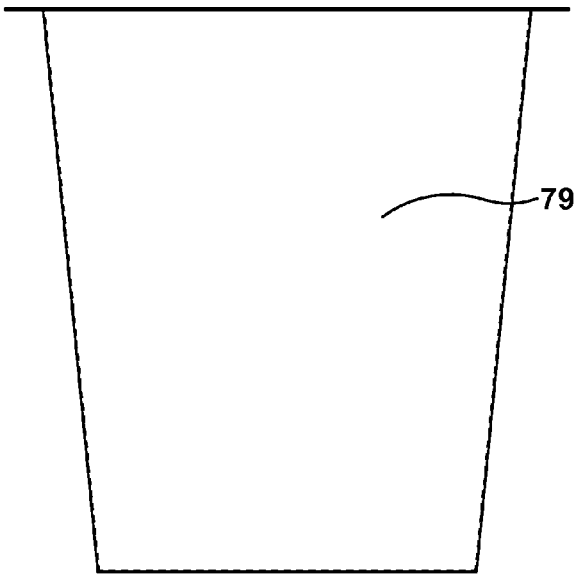
Figure 11:
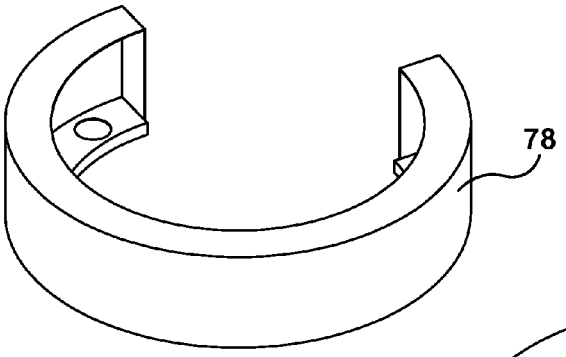
FIGS. 11-14 are various views of one aspect of the manifold discussed above.
Figure 12:
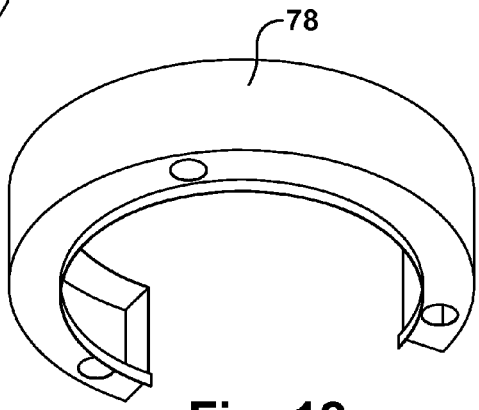
Figure 13:
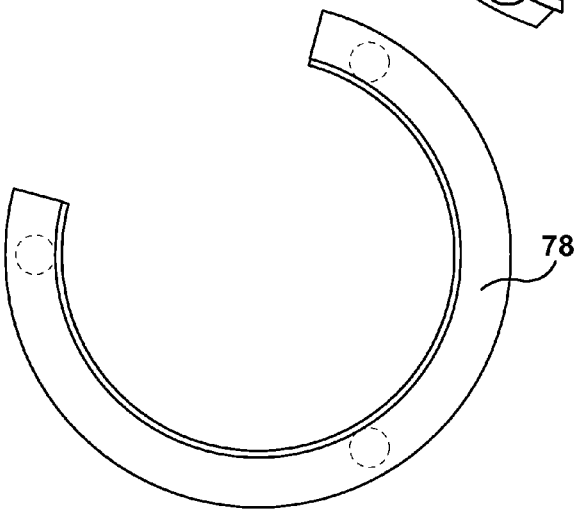
Figure 14:
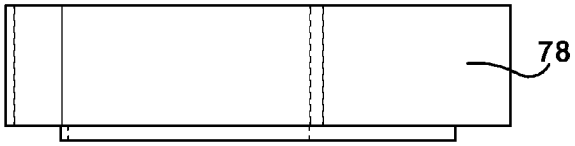

On the other hand, referring to FIG. 8, a separate gas source 62 may be used in place of or in addition to the air from the manifold to provide gas to the post(s) 38 and possibly along the pump shaft 12. The separate gas source 62 can be a tank of air and/or inert gas under pressure, for example (nitrogen and/or argon gas). A conduit 60 can extend from the gas source 62 above the molten metal as shown in FIG. 8. In all embodiments herein, the conduit from the gas source to the post(s) is made of a suitable material, for example, a flexible and/or heat resistant conduit. The conduit might also be metal. The separate gas source 62 may be used in any aspect of this disclosure (such as when gas exits an upper location of the post through opening 66, through a lower opening 84, or when the gas does not leave the passageway 44 of the post through a transverse opening in the post).

In one variation, referring to FIG. 6, at least one optional opening 66 can extend from the passageway 44 to an outer exterior surface 68 of the post(s) 38. Gas 70 such as air and/or inert gas (e.g., argon and/or nitrogen) flows through the conduit 60 into the passageway 44. The gas that is fed into the passageway 44, and through the optional opening 66 of the post, leaves the post and may travel (e.g., downwardly) near or along the outer surface 68 of the post when the gas has a higher density than air.

The post and pump shaft may each be formed with an optional ceramic sleeve 82 made of, for example, silicon carbide, which prevents abrasion of these components from metal oxides and other materials present in the molten metal. Exterior surface 68 is an exterior surface of the sleeve (or exterior surface of the post if no sleeve is used). Despite the presence of the ceramic sleeve in the prior art, the oxidation reaction still proceeded to weaken the shaft and post near the molten metal-air interface without the temperature reducing and/or abrasion resistant features of this disclosure. Therefore, the method of this disclosure in which gas is flowed inside the post and possibly around the outside of the post and/or shaft, may be used with the sleeve containing-post and possibly the sleeve-containing shaft.

Referring to FIG. 7, it may be possible to extend the passageway 44 of the post (or shaft) past the molten metal-air interface 40 to the lower end portion 50 of the post (or shaft) below the interface 40 (e.g., near the base 28), if the post has sufficient strength for this. A lower end portion of the passageway 44 extends to at least one optional outer opening 84 leading to the exterior surface 68 of the post (as part of an optional ceramic sleeve 82 or possibly uncovered exterior surface of the post). A porous refractory plug 83 may be present in the opening 84 (or opening 66) to permit flow of gas through it but to prevent molten metal from entering the opening or the passageway 44. Then, gas 70 such as inert gas can flow inside the post 38 (or shaft) down most of its length to the outer opening 84 where it may leave the post (or shaft) and flow upward, being less dense than air (e.g., nitrogen), along the post (or shaft) outer surface 68.

The flow of gas out the opening 66 and upward or downward along or near the post and/or shaft (e.g., along the exterior surface of the post) may provide the post and/or shaft with a cooler temperature and/or an envelope of gas around its exterior surface that moves the dross solid material (e.g., aluminum oxides therein in the case of pumping of aluminum metal) away from the post and/or shaft and inhibits oxidation and/or abrasion along the entire length thereof, and especially at the molten metal/air interface 40. In all embodiments of this disclosure, multiple openings 84 (or 66) may be used so that the gas leaves the passageway 44 around a circumference of the post so as to surround the post and possibly the shaft as it travels upward or downward.

An example method of inhibiting oxidation and/dross abrasion of a post in a pump for pumping molten metal includes providing the pump 10 as described above. The pump base 28 is submerged in the molten metal 24 and the motor 18 is activated, rotating the drive shaft 17 and, in turn, via coupling 20, the shaft 12 and impeller 22 in the molten metal. While the posts are submerged in the molten metal, gas 70 is fed along the conduit 60 and into the passageway 44 of the posts 38. The flowing gas 70 is expected to cool the post 38, in particular, to a temperature at which the rate of oxidation of the graphite is reduced compared to the rate of oxidation of the graphite at the molten metal temperature. The passageway 44 extends near to or at the molten metal/air interface 24 so as to cool at least the interface region of the post. Placing the passageway near but at a location only above the molten metal-air interface 24 provides the advantage that the passageway does not weaken the post in the interface area 76 where the post is normally susceptible to wear, oxidation and breakage (as shown by the crescent shaped wear of the post in FIG. 5). If an opening 66 or 84 extends from the passageway 44 in the post to the exterior surface of the post, gas may be flowed upwardly or downwardly (depending on the density of the gas relative to the density of air) along or near the post (e.g., along the exterior surface of the post), which may prevent an abrasive effect of the dross on the post.

Many modifications and variations of the example embodiments will be apparent to those of ordinary skill in the art in light of the foregoing disclosure. Therefore, it is to be understood that, within the scope of the appended claims, the invention can be practiced otherwise than has been specifically shown and described.

What is claimed is:

1. A pump for pumping molten metal comprising:

a pump shaft having an upper end and a lower end;

a motor connected to the upper end of the shaft;

an impeller fastened to the lower end of the shaft;

support structure supporting the motor above the molten metal;

a base disposed below the support structure including an impeller chamber in which the impeller is rotated by activation of the motor, wherein said base includes at least one inlet opening leading to the impeller chamber and at least one outlet passageway leading from the impeller chamber;

at least one support post extending between said support structure and said base enabling the base to be submerged in the molten metal beneath said support structure; and a device that enables said post to resist deterioration from at least one of oxidation and abrasion while the post is disposed in the molten metal.

2. The pump of claim 1 wherein said post includes a passageway along a length of said post and said device that enables said post to resist deterioration includes a gas source and a conduit that extends between said gas source and said passageway.

3. The pump of claim 1 wherein said device that enables said post to resist deterioration includes a manifold disposed around and fastened to said motor, wherein air travels around said motor for cooling said motor, enters said manifold and travels from an opening in said manifold to said post.

4. The pump of claim 3 wherein an airflow directing member extending from said manifold releases air along an exterior surface of said shaft.

5. The pump of claim 3 wherein said manifold opening releases air along or near an exterior surface of said post.

6. The pump of claim 3 wherein said post includes a passageway and a conduit extends between said manifold opening and said passageway, wherein air in said manifold flows into said passageway and enables the post to resist oxidation.

7. The pump of claim 2 wherein the gas source includes air and/or inert gas under pressure.

8. The pump of claim 2 wherein the passageway extends in the post to a location near an interface of molten metal and air.

9. The pump of claim 8 wherein the passageway is located only above the interface.

10. The pump of claim 2 including at least one opening extending from the passageway to an exterior surface of the post, wherein gas in the passageway travels through the opening out said post and travels along or near said post.

11. The pump of claim 10 wherein the opening is located near an interface of molten metal and air.

12. The pump of claim 10 wherein the passageway extends to and ends at an upper location of the post above an interface of molten metal and air, and the gas travels through the opening out said post and downward along or near said post.

13. The pump of claim 10 wherein the passageway extends to and ends at a lower location of the post below an interface of molten metal and air, and the gas travels through the opening out said post and upward along or near said post.

14. The pump of claim 13 wherein the gas has a density that is less than a density of air.

15. The pump of claim 12 wherein the gas has a density that is greater than a density of air.

16. The pump of claim 1 wherein the post is comprised of graphite.

17. The pump of claim 1 wherein the post includes a ceramic sleeve.

18. A pump for pumping molten metal comprising:

a pump shaft having an upper end and a lower end;

a motor connected to the upper end of the shaft;

an impeller fastened to the lower end of the shaft;

support structure supporting the motor above the molten metal;

a base disposed below the support structure including an impeller chamber in which the impeller is rotated by activation of the motor, wherein said base includes at least one inlet opening leading to the impeller chamber and at least one outlet passageway leading from the impeller chamber;

at least one support post extending between said support structure and said base enabling the base to be submerged in the molten metal beneath said support structure; and a gas source and a gas flow member leading from said gas source to a location above said post for flowing gas outside of said post that moves dross solids away from said post.

* * * * *